US011493062B1

(12) United States Patent
Andersen

(10) Patent No.: US 11,493,062 B1
(45) Date of Patent: Nov. 8, 2022

(54) SUBMERSIBLE ACTUATOR

(71) Applicant: L3Harris Technologies, Inc., Melbourne, FL (US)

(72) Inventor: Jesper Andersen, Bel Air, MD (US)

(73) Assignee: L3Harris Technologies, Inc., Melbourne, FL (US)

( * ) Notice: Subject to any disclaimer, the term of this patent is extended or adjusted under 35 U.S.C. 154(b) by 0 days.

(21) Appl. No.: 17/497,148

(22) Filed: Oct. 8, 2021

(51) Int. Cl.
*F15B 15/14* (2006.01)
*F15B 15/20* (2006.01)

(52) U.S. Cl.
CPC ..... *F15B 15/14* (2013.01); *F15B 15/202* (2013.01)

(58) Field of Classification Search
CPC ..... F15B 15/14; F15B 15/202; G01F 23/00; G01F 23/16; G01F 23/161; G01F 23/164; G01L 7/16; G01L 7/163; G01L 7/166
See application file for complete search history.

(56) References Cited

U.S. PATENT DOCUMENTS 3,394,590 A * 7/1968 Napolitano ..... G01F 23/16 73/299
6,047,131 A * 4/2000 Smith ..... G03B 17/08 396/26
6,125,218 A * 9/2000 Humphrey ..... G02B 6/353 385/13
2008/0041710 A1* 2/2008 Kranjc ..... D06F 39/087 200/83 R

FOREIGN PATENT DOCUMENTS

DE 3533412 A * 12/1986 ..... G01F 23/164
DE 102011005836 B3 * 6/2012 ..... G01F 15/061
DE 202015104928 U1 * 10/2015 ..... G01L 7/163
FR 2341850 A1 * 9/1977 ..... G01F 23/16
JP 58017319 A * 2/1983 ..... G01F 23/16

* cited by examiner

*Primary Examiner* — Michael Leslie
*Assistant Examiner* — Matthew Wiblin
(74) *Attorney, Agent, or Firm* — Edell, Shapiro & Finnan, LLC

(57) ABSTRACT

An actuator configured to be submerged into a body of water and to activate upon achieving a particular depth. The actuator includes a housing that defines a chamber. The housing has an open end portion in which is located a piston, the piston closing the open end portion to cause the chamber to be watertight. The piston has a first side facing an inner wall of the chamber and a second side opposite the first side that is configured to face the body of water, the piston being translatable in the chamber. A column located inside the chamber has a first end coupled to the first side of the piston and a second end coupled the inner wall of the chamber, the column being configured to buckle upon a predetermined amount of force being applied to the second side of the piston to cause the piston to translate.

20 Claims, 7 Drawing Sheets

SUBMERSIBLE ACTUATOR

TECHNICAL FIELD

The present disclosure relates to a submersible actuator utilizing water depth induced buckling.

BACKGROUND

Certain underwater systems require a means of initiating a physical process at a prescribed depth in a given body of water. A prior art electro-mechanical actuator 10 is shown in FIG. 1. Circuitry 12 inside the actuator is coupled to a pressure sensor (not shown) that senses water pressure outside the housing of the actuator. The actuator includes an electric motor 13 that is powered by an on-board battery. 14. When the outside water pressure reaches a threshold value, the pressure sensor (not shown) communicates with the on-board circuitry 12 to cause the electric motor 13 to be energized by the battery 14. This results in a threaded driveshaft 15 that is coupled to the motor by a gearbox to rotate. Upon multiple revolutions of the threaded driveshaft 15, an actuating lever 16 is freed from the driveshaft 15 or caused to move with the driveshaft so that the lever is caused to articulate. The lever 16 may be coupled to a switch or other device (not shown) that when triggered by the lever causes a physical process to initiate.

The electro-mechanical actuator 10 shown in FIG. 1 has a number of disadvantages. First, it requires the use of a battery that can limit the useful life of the actuator or require a periodic changing of the battery. Second, the actuator requires a multitude of relatively complex parts (motor, gear box assembly, driveshaft, bearings, couplers, pressure sensor, electrical circuit, etc.) that are subject to failure. Third, the cost of the actuator is relatively high. Lastly, this actuator may remain on the seabed floor, eventually allowing the environmentally adverse chemicals within the battery to leak into the ocean.

The present disclosure provides devices, systems and methods that resolve or at least reduce some of the aforementioned disadvantages.

SUMMARY

According to one implementation, a submersible actuator using depth induced buckling is provided that includes a closed internal chamber that is occupied by a compressible gas (e.g. air). The chamber is closed at one end by a piston having a first side facing into the chamber and a second side that is configured to be exposed to a body of water. The piston is configured to translate inward into the chamber when a threshold pressure is applied to its second side by the water acting on it. Inside the chamber is a column having a first end coupled to an inner wall of the chamber and a second end coupled to the first side of the piston. The column is configured to prevent inward movement of the piston into the chamber until the threshold pressure exerted by the water is applied to the second side of the piston, the threshold pressure being associated with a depth of the actuator in the body of water. A stop located inside the chamber limits the amount by which the piston is allowed to translate inward into the chamber. Consequently, a controlled movement of the piston is achieved by use of the column and the stop.

In use, a first end of a linkage is coupled to the second side of the piston and a second end of the linkage is coupled to a switch or other device such that when triggered by the movement of the linkage causes a physical process to initiate.

According to another implementation, a pressure relief valve connected to the internal chamber is provided to facilitate a release of the compressible gas from the chamber when the pressure inside the chamber exceeds a given pressure, and thus increasing the available net force from the piston.

One advantage of the submersible actuator using depth induced buckling is that it has no electrical parts that require the use of a battery. As such, the useful life of the actuator is not limited to the life of a battery or alternatively does not require the replacement of a battery. The simple construction of the actuator makes it less prone to failure and results in a low cost device.

These and other advantages and features will become evident in view of the drawings and detailed description.

DETAILED DESCRIPTION

Figure 1:
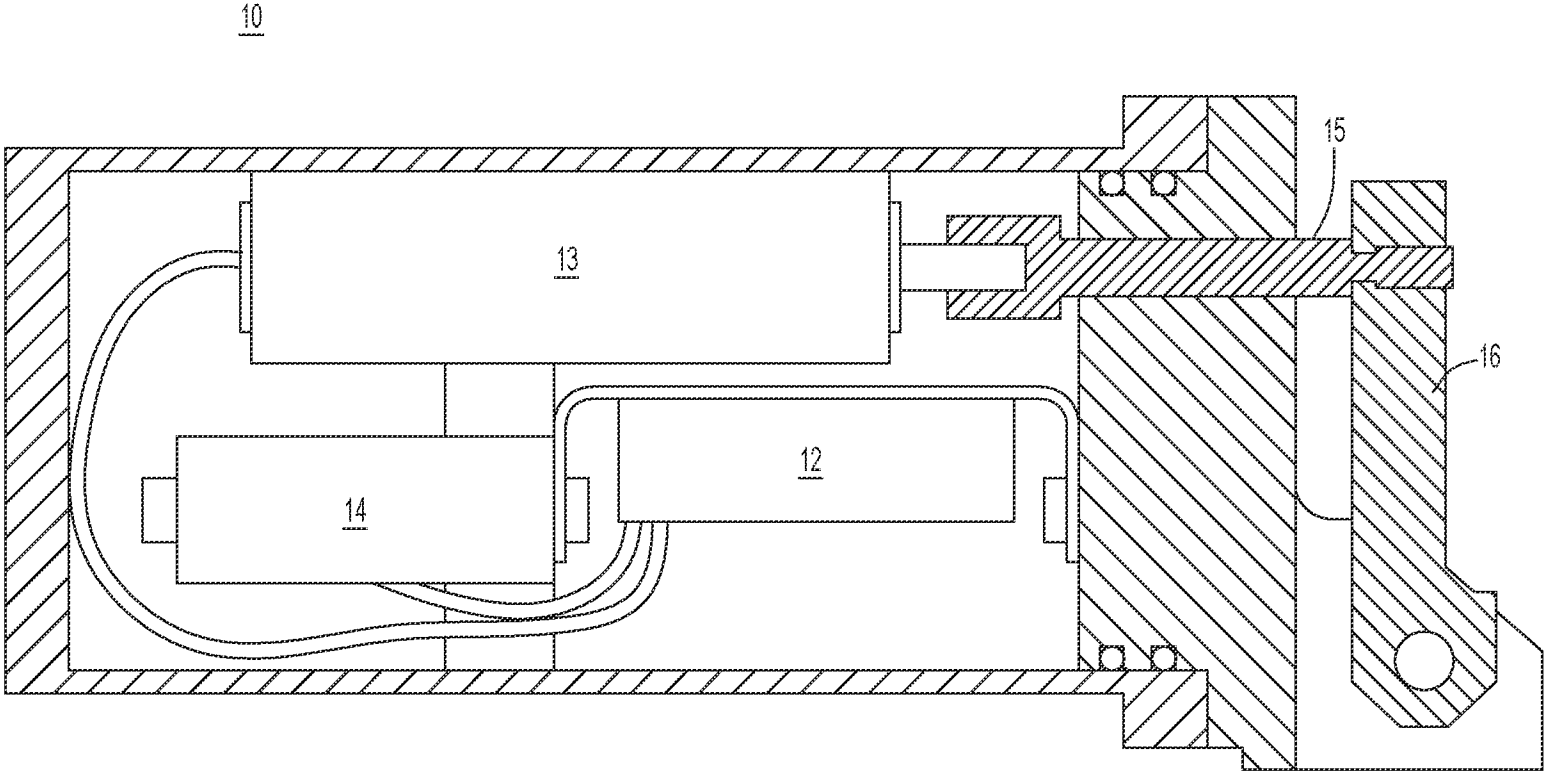
FIG.1 PRIOR ART
FIG. 1 is a prior art electro-mechanical actuator.
Figure 2B:
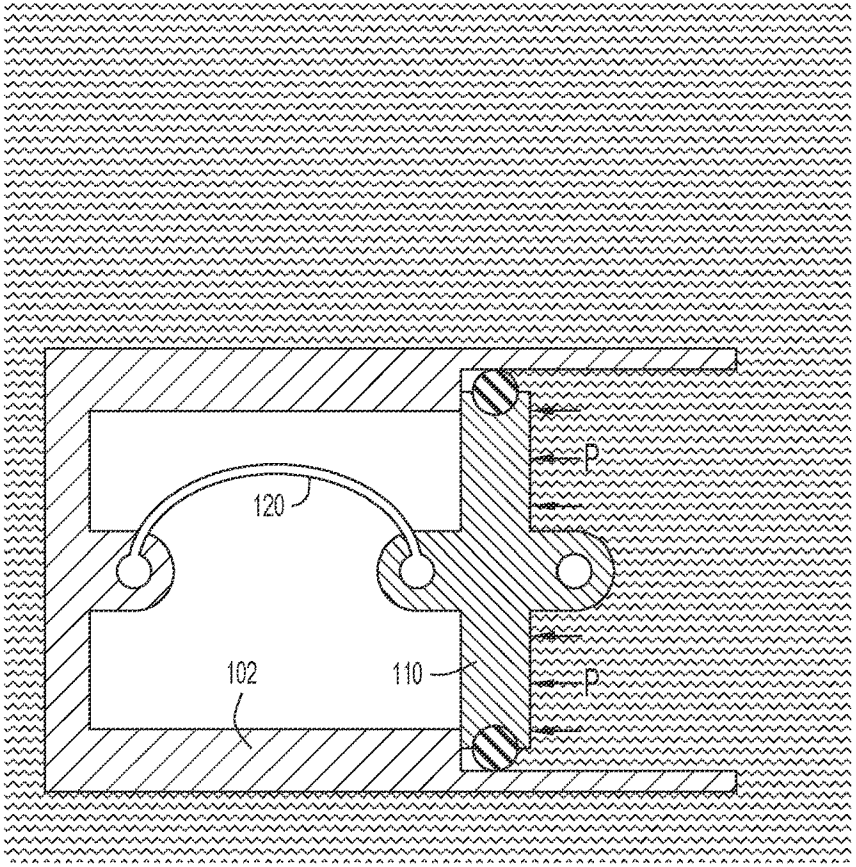
FIG. 2B schematically illustrates a cross-section view of the submersible actuator of FIG. 2A in a activated position.
Figure 2A:
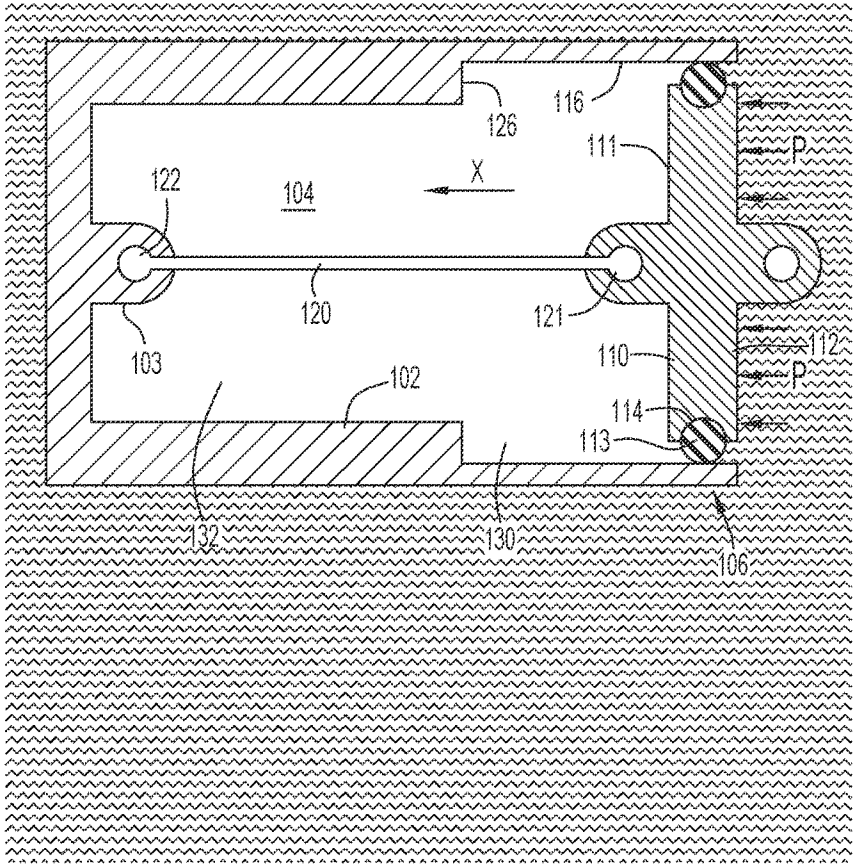
FIG. 2A schematically illustrates a cross-section view of a submersible actuator according to one implementation in a ready position.

FIGS. 2A and 2B respectively illustrate cross-section views of an actuator 100 in a ready state and an activated state according to one implementation. The actuator 100 is configured to be submerged into a body of water and to activate upon achieving a particular depth in the body of water.

The actuator 100 includes a housing 102 that defines an internal chamber 104. The housing 102 includes an end portion 106 in which resides a piston 110 that is able to translate inwardly into the chamber in the direction X as will be described in more detail below. The piston has a first side 111 that faces into the internal chamber 104 and a second face 112 that faces outward in a direction away from the internal chamber such that when the actuator is submerged in the body of water, water pressure P acts on the second side of the piston to force it inwardly into the chamber in the direction X.

The actuator 100 further includes a column 120 having a first end 121 coupled to the first side of the piston 111 and a second end 122 coupled to an inner wall 103 of the internal chamber. As shown in FIG. 2A, when the actuator is in the ready position, the column is straight to hold the piston 110 in an initial position. As shown in FIG. 2B, the column 120 is configured to buckle/bend upon a predetermined amount of force being applied to the second side 112 of the piston 110. The bending of the column 120 permits movement of the piston in the X direction so that the actuator may assume its activated position after assuming a particular depth, or range of depth, in the body of water.

According to one implementation, when the column 120 buckles as the actuator transitions from the ready state to the activated state, it does so elastically so that it is able to recover most (at least 75%) or all of its original length. The advantage of utilizing a column that is configured to substantially regain or fully regain its original length is that it allows the actuator to be used multiple times.

According to one implementation, the actuator includes an elastomeric ring/gasket 113 that resides inside a perimeter groove 114 of the piston 110, the piston and gasket are configured such that the gasket presses against an inner circumferential wall 116 of the chamber 104 to produce a leak-tight seal between the piston and the circumferential wall. According to one implementation the periphery of the piston 110 is circular and the elastomer ring 113 is an elastomeric O-ring.

According to one implementation, the gasket or O-ring is configured to permit a passage of the compressible gas located in the internal chamber to an outside of the internal chamber upon the gas reaching a given elevated pressure inside the internal chamber. This ensures that the intended full movement of the piston in the X direction is not limited by a buildup of excessive pressure inside the chamber.

Figure 4:
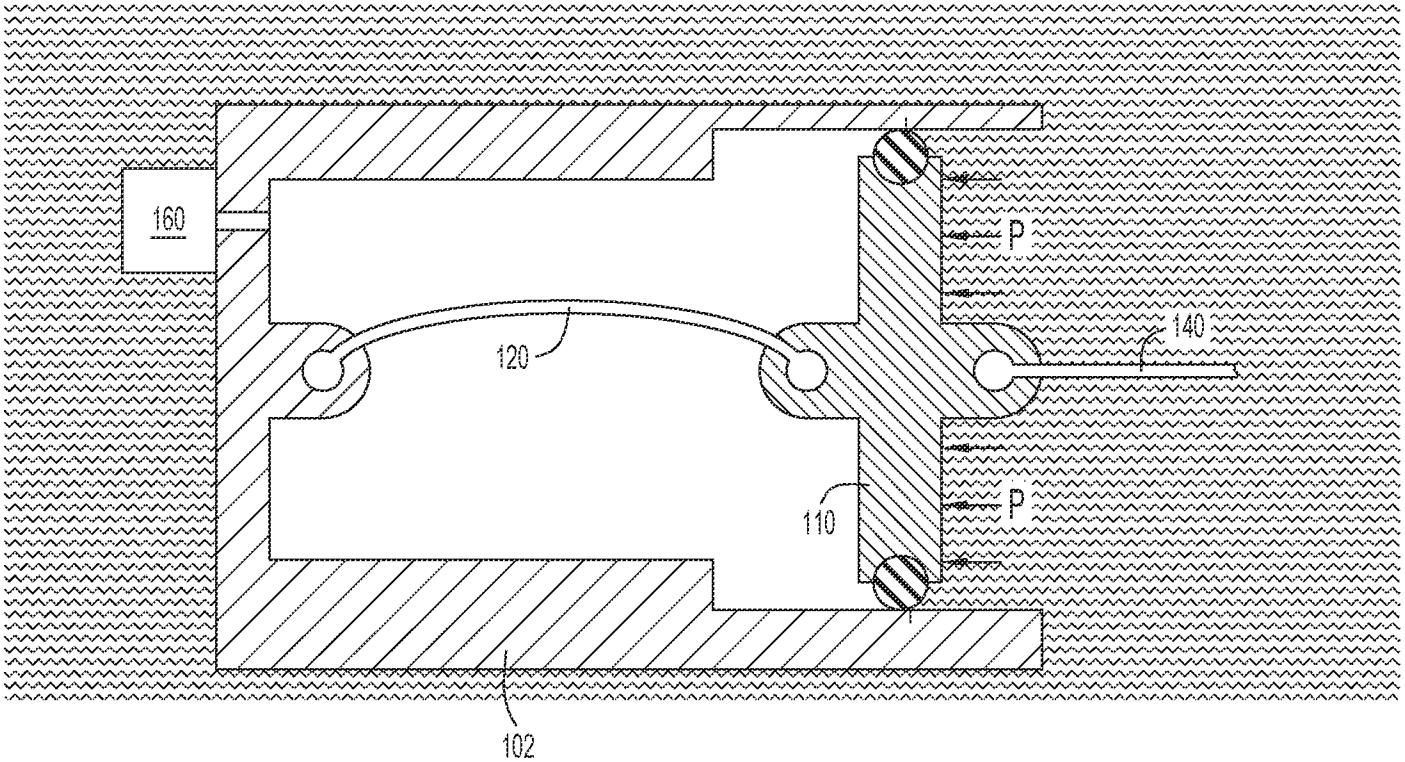
FIG. 4 shows the submersible actuator of FIG. 2A with the addition of a pressure relief valve that is in fluid communication with the internal chamber of the actuator.

According to another implementation, as shown in FIG. 4, the actuator 100 includes a pressure relief valve 160 that is in fluid communication with the internal chamber 104. The pressure relief valve 160 is configured to expel the compressible gas from the internal chamber to an outside of the internal chamber when a pressure of the compressible gas exceeds a predetermined pressure. The release of the gas serves the same function as that discussed above. It ensures that the intended full movement of the piston in the X direction is not limited by a buildup of excessive pressure inside the chamber.

According to the implementations shown in the figures, the chamber 104 includes a proximal end portion 130 and a distal end portion 132 with the proximal end portion having a greater cross-sectional area than that of the distal end portion, the difference in cross-sectional areas creating a shoulder acting as a stop 126 that limits the movement of the piston in the X direction.

According to one implementation, the piston and cross-sectional areas of the proximal and distal end portions of the chamber are circular in shape. In such an instance, the stop 126 comprises an annular shoulder located at the boundary of the proximal and distal end portions 130, 132 of the chamber 104.

Figure 3:
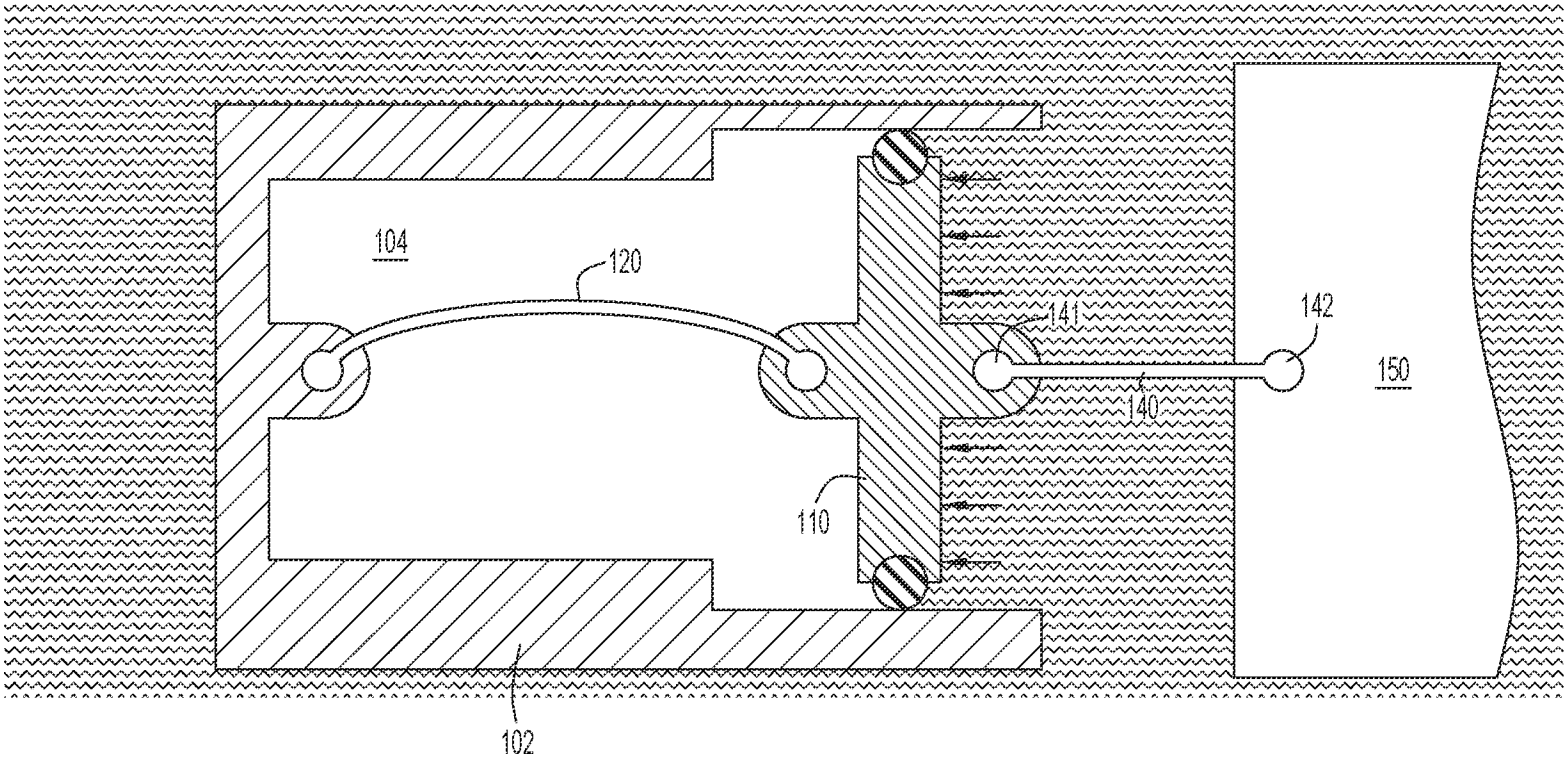
FIG. 3 shows the submersible actuator of FIG. 2A being coupled to a device to be actuated by a linkage.

As shown in FIG. 3, in use the piston 110 is coupled to a device 150 that is controlled, at least in part, by the repositioning of the piston inside the chamber 104. The piston 110 is coupled to the device 150 by a linkage 140. The linkage 140 includes a first end 141 coupled to the piston 110 and a second end 142 configured to be coupled to the device 150. The actuator 100 is configured such that when the piston 110 has moved in the X direction by a particular amount, the linkage also moves to act on a switch, a lever, or other part of the device 150 to cause a physical or electrical process to initiate.

According to some implementations, the linkage is configured to apply at the second end of the linkage a force that is the same as a force applied to the first end of the linkage. According to other implementations the linkage 140 is configured to apply at the second end of the linkage a force that is greater than a force applied to the first end of the linkage. According to yet other implementations, the linkage is configured to cause the second end of the linkage to rotate as the first end of the linkage is moved linearly with the piston 110.

According to some implementations, the housing 102 and the piston 110 are made of a high strength plastic that can withstand substantially pressure when the actuator 100 is deployed into a body of water so that the inner walls of the housing that define the chamber remain unaltered. According to one implementation each of the housing 102 and the piston 110 is formed by a molding process. One advantage of using a plastic is that the cost of materials is low and manufacturing methods to produce the parts is made simple. Another important advantage of using plastics is that they are not subject to corrosion when exposed to the body of water in which the actuator is intended to reside. This aids in extending the useful life of the actuator.

According to some implementations each of the housing and piston is made of a plastic material (the same or different plastic materials) and the column is made of a metal, such as Aluminum or steel, or alloys of these metals. The column may also be made of a polymeric material or a composite material that has load bearing properties conducive to the buckling behavior. Such mechanical properties would result in repeatability of the force at which the column would buckle, called the critical load, according to Euler buckling equation.

The housing and piston may also be made of a metal, such as, for example aluminum and steel.

According to some implementations the components of the actuator made of polymeric materials may be constructed by injection molding or Additive Manufacturing (i.e. 3D printing). Metallic material components may be formed by die casting or by traditional CNC (Computer Numerical Control) machining.

Figure 5B:
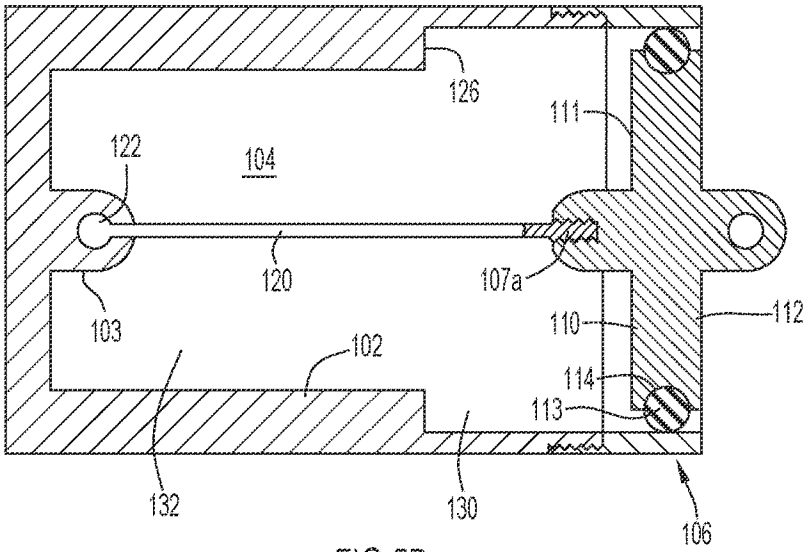
FIGS. 5A and 5B illustrate a method of assembling a submersible actuator according to one implementation.
Figure 5A:
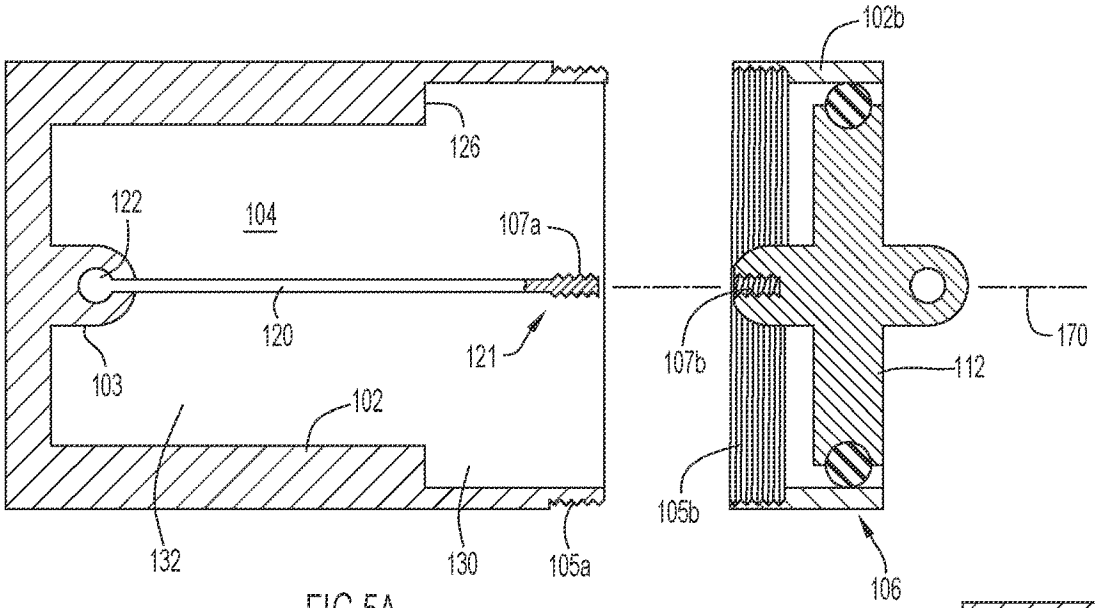

FIGS. 5A and 5B illustrate a method of assembling a submersible actuator according to one implementation. The housing includes a first part 102*a* having external threads 105*a* and a second part 102*b* having internal threads 105*b*. According to another implementation, the first part of the housing 102*a* possess external threads and the second part of the housing 102 includes internal threads 105*b*. Prior to a coupling of the first and second parts of the housing, the second end 122 of the column is secured to the first part of the housing 102*a* so that the column extends along or parallel to a centerline 170 of the actuator. The second end 122 of column 120 is secured to the first part of the housing in a manner that prevents the column from pivoting with respect to the actuator housing 102*a*. According to one implementation the second end 122 of column 120 is threaded onto the first part of the 102*a*. According to other implementations the second end 122 of column 120 is securely attached to the first part of the housing 102*a* by welded connection or by an adhesively bonded connection.

Prior to a coupling together of the first and second parts of the housing, the piston 110 is positioned inside the second part of the housing 102*b* as shown in FIG. 5A. In the implementation shown, the first end 121 of the column 120 includes external threads 107*a* and the piston 110 includes internal threads 107*b*. In the arrangement of FIG. 5A, with the first and second parts of the housing 102*a*, 102*b* being axially aligned with centerline 170, the two parts 102*a* and 102*b* are then positioned to but up against one another. Thereafter, at least one of the first and second parts 102*a* and 102*b* is rotated to cause a mating of their respective external and internal threads 105*a* and 105*b*. Column 120 and piston 110 are arranged so that as the external and internal threads 105*a* and 105*b* mate with one another, concurrently therewith the external threads 107*a* of the first end of the column 120 are caused to mate with the internal threads 107*b* of the piston 110 to effectuate a coupling of the column to the piston. FIG. 5B shows the actuator of FIG. 5A in an assembled state.

According to one implementation, a tool or other means is used to prevent a rotation of the piston 110 inside the second part of the housing 102*b* as the piston is being threaded onto the first end of the column. According to other implementations, the piston 110 engages a stop (not shown in the figures) located inside the second part of the housing 102*b* to prevent or limit the piston's rotation inside the housing to ensure the threaded coupling of the first end of the column with the piston is maintained.

According to another implementation, the connection scheme of FIGS. 5A and 5B may be reversed. That is, the first end 121 of the column 120 may be welded or adhesively bonded to the piston 110 and the second end 122 of the column 120 may be coupled to the first part of the housing 102*a* by a threaded connection.

According to other implementations the first and second ends 121 and 122 of column 120 may be respectively affixed to the piston 110 and to housing 102*a* by clips, latches or any other means that prevent the ends of the column from pivoting with respect to the component to which it is attached.

Figure 6A:
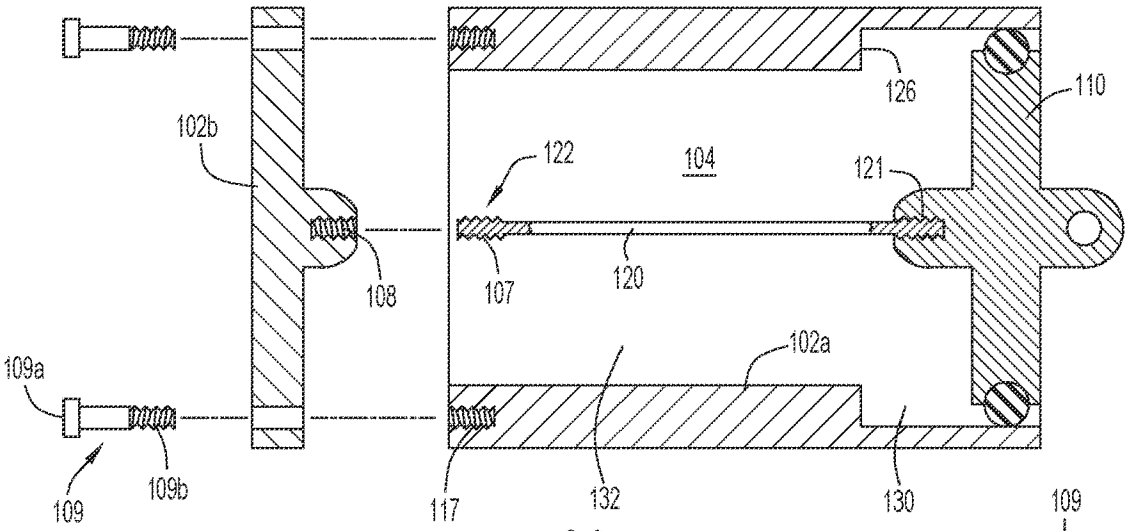
FIGS. 6A and 6B illustrate a method of assembling a submersible actuator according to another implementation.
Figure 6B:
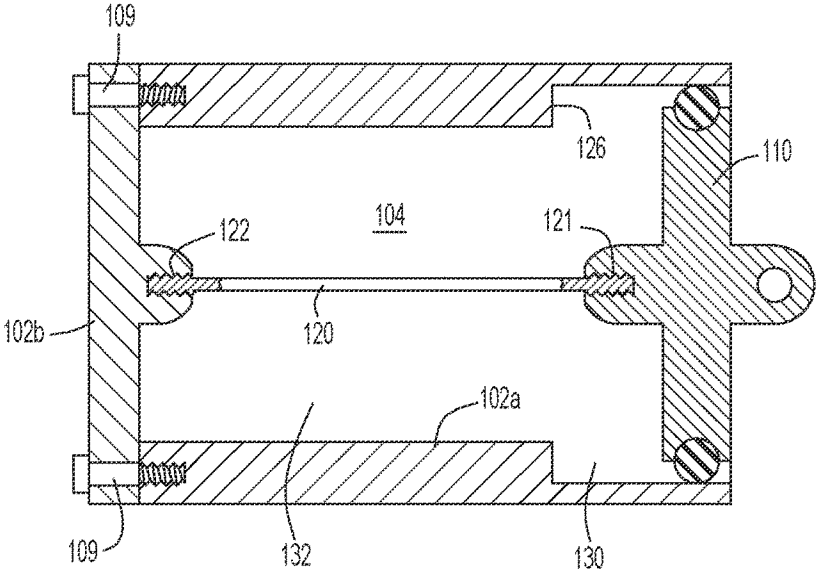

FIGS. 6A and 6B illustrate another method for assembling a submersible actuator. Like the actuators previously disclosed herein, the actuator of FIGS. 6A and 6B includes a housing 102*a*,102*b* and a piston 110, that together delimit an internal chamber 104. The housing comprises a first part 102*a* in which resides the piston 110, and a second part/end cap 102*b* that is affixed to an end of the first part 102*a* by a plurality of bolts 109. In the assembled state, as shown in FIG. 6B, the first and second ends 121, 122 of column 120 are respectively secured to the piston 110 and the end cap 102*b* by first and second threaded connections. The first end 121 of column 120 includes external threads and the piston 110 includes internal threads that when mated together form the first threaded connection. The second end 122 of column 120 includes external threads and the end cap 102*b* includes internal threads that when mated together form the second threaded connection. As will be discussed in more detail below, the first and second ends of column 120 may respectively be secured to the piston 110 and end cap 102*b* by other types of attachment means.

According to one implementation, with the piston 110 having the first end 121 of the column 120 attached to it, the piston is placed inside the proximal end portion 130 of chamber 104 as shown in FIG. 6A such that the second end 122 of column 120 resides at or adjacent an end of housing 102*a*. The end cap 102*b* is then positioned to align the external threads 107 at the second end of the column with the internal threads 108 of the end cap 102*b*. Thereafter, the end cap 102*b* is rotated to cause a mating of the external and internal threads 107 and 108. The end cap 102*b* is rotated until there is a firm abutment of the end cap with the end of the first part of the housing 102*a*. Bolts 109 are then used to press the end cap 102*b* against the first part of the housing 102*a* so that a watertight seal exists between them. The bolts 109 include externally threaded ends 109*b* that engage with internal threads 117 located in the first part of the housing 102*a*. Each of the bolts 109 also includes a head 109*a* having an annular surface that faces and presses against an outside surface of the end cap 102*b* when the actuator is in the assembled state. Although not shown in the figures, a gasket is preferably disposed between the end cap 102*b* and first part of the housing 102*a* to effectuate the watertight seal. When assembled, the actuator functions similarly to the actuators of FIGS. 2-4 discussed above.

With continued reference to FIGS. 6A and 6B, the manner in which the first and second ends of the column 120 are respectively attached to the piston 110 and to the end cap 102*b* need not be a threaded connection. For example, according to other implementations the first end 121 of column 120 may be secured to the piston 110 by a weld, an adhesive or via a snap-fit connection, and the second end 122 of column 120 may be secured to the end cap 102*b* by an adhesive or via a snap-fit connection. In implementations where the second end 122 of the column is secured to the end cap 102*b* via a non-threaded connection, the assembly method does not require a rotating of the end cap.

Figure 7B:
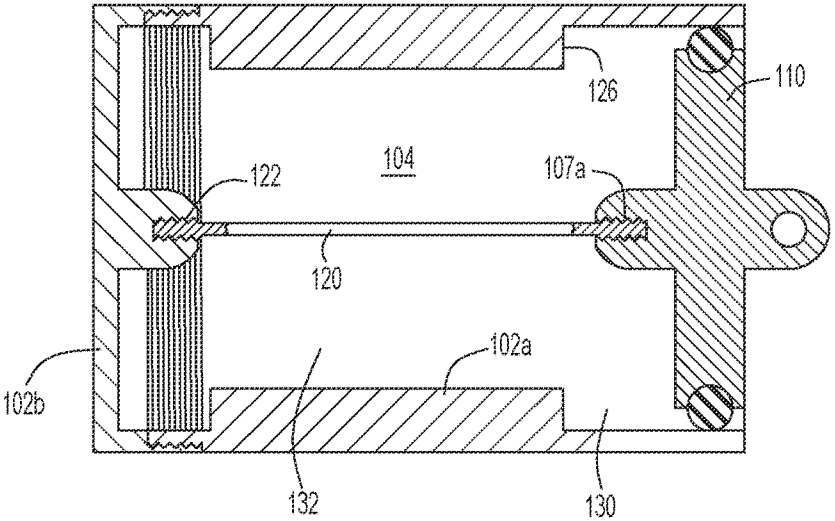
FIGS. 7A and 7B illustrate a method of assembling a submersible actuator according to yet another implementation.
Figure 7A:
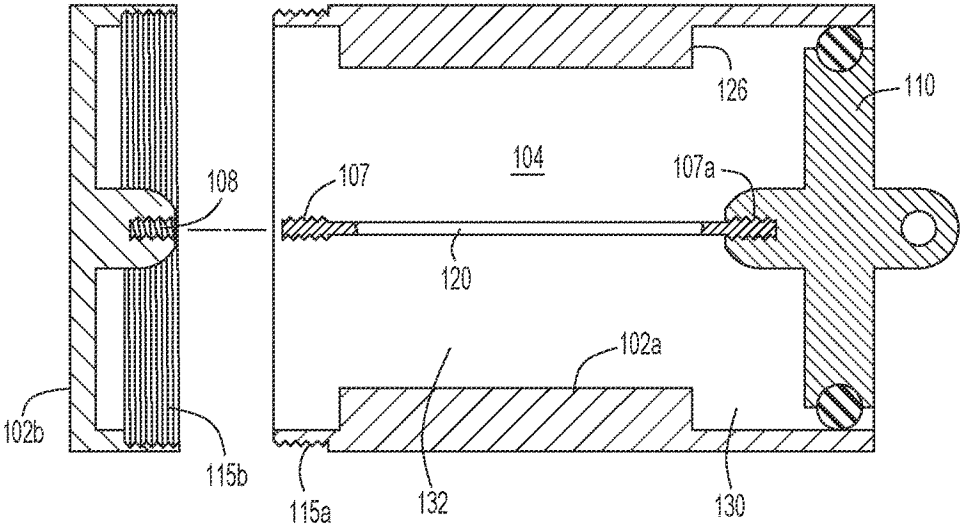

FIGS. 7A and 7B illustrate a method of assembling a submersible actuator according to another implementation. The method is similar to the method shown in FIGS. 6A and 6B with the exception that the end cap 102*b* is secured to the first part of the housing 102*a* by a threaded connection and not by a bolted connection. In the example of FIGS. 7A and 7B, the threaded connection is facilitated by internal threads 115*b* of the end cap 102*b* engaging external threads 115*a* of the first part of the housing 102*a*. A coupling of the end cap 102*b* with the first part of the housing 102*a* is achieved by rotating the end cap with respect to the first part of the housing until an assembled state of the actuator is achieved as shown in FIG. 7B.

It is important to note that the manner in which the first and second parts 102*a* and 102*b* are connected to one another need not be a bolted or threaded connection. For example, according to other implementations the second part of the housing may be secured to the first part of the housing 102*a* by a weld, an adhesive or a snap-fit connection.

It is also important to note that the manner in which the first end 121 of the column 120 is attached to the piston 110 need not be a threaded connection. For example, according to other implementations the first end 121 of column 120 may be secured to the piston 110 by a weld, an adhesive or a snap-fit connection, Although only a number of examples have been disclosed herein, other alternatives, modifications, uses and/or equivalents thereof are possible. Furthermore, all possible combinations of the described examples are also covered. Thus, the scope of the present disclosure should not be limited by the particular examples disclosed herein.

What is claimed is:

1. An actuator configured to be submerged into a body of water and to activate upon achieving a particular depth in the body of water, the actuator comprising:

a housing that partially defines an internal chamber, the housing having an open end portion;

a piston located inside and translatable in the internal chamber, the piston closing the open end portion of the housing to cause the internal chamber to be watertight, the piston having a first side that faces an inner wall of the internal chamber and a second side opposite the first side that is configured to face the body of water, the piston being translatable in a direction towards the inner wall of the internal chamber;

a column having a first end coupled to the first side of the piston and a second end coupled to the inner wall of the internal chamber, the column configured to buckle upon a predetermined amount of force being applied to the second side of the piston; and a stop located in the internal chamber to limit a distance by which the piston is translatable inward inside the internal chamber.

2. The actuator according to claim 1, wherein the internal chamber is filled with a compressible gas.

3. The actuator according to claim 2, wherein the compressible gas is air.

4. The actuator according to claim 2, wherein the piston includes a gasket that resides inside a perimeter groove of the piston, the piston and gasket being configured such that the gasket presses against an inner circumferential wall of the internal chamber to produce a watertight seal between the piston and the inner circumferential wall.

5. The actuator according to claim 4, wherein the gasket is configured to permit a passage of the compressible gas located in the internal chamber to an outside of the internal chamber upon the compressible gas reaching a given pressure inside the internal chamber.

6. The actuator according to claim 2, further comprising a pressure relief valve that is in fluid contact with the internal chamber, the pressure relief valve being configured to expel the compressible gas from the internal chamber to an outside of the internal chamber when a pressure of the compressible gas exceeds a predetermined pressure.

7. The actuator according to claim 1, further comprising a linkage having a first end coupled to the second side of the piston, a second end of the linkage configured to be coupled to a device that when triggered by a movement of the linkage causes a physical process to initiate.

8. The actuator according to claim 1, wherein the actuator is configured to assume a ready position and an activated position, in the ready position the piston is in a first position with the column being straight and in the activated position the piston is in a second position with the column being curved.

9. The actuator according to claim 7, wherein the linkage is configured to apply at the second end of the linkage a force that is greater than a force applied to the first end of the linkage.

10. The actuator according to claim 7, wherein the linkage is configured to apply at the second end of the linkage a force that is the same as a force applied to the first end of the linkage.

11. The actuator according to claim 7, wherein the linkage is configured to cause the second end of the linkage to rotate as the first end of the linkage is moved linearly with the piston.

12. The actuator according to claim 1, wherein the piston is circular and includes an elastomeric O-ring that resides inside a perimeter groove of the piston, the piston and elastomeric O-ring being configured such that the O-ring presses against an inner circumferential wall of the internal chamber to produce a watertight seal between the piston and the inner circumferential wall.

13. The actuator according to claim 1, further comprising a pressure relief valve that is in fluid contact with the internal chamber.

14. The actuator according to claim 1, wherein the stop is defined by a wall of the housing.

15. The actuator according to claim 1, wherein the housing is a made of a plastic.

16. The actuator according to claim 1, wherein the piston is a made of a plastic.

17. The actuator according to claim 1, wherein the each of the housing and piston is made of a plastic and the column is made of a metal.

18. The actuator according to claim 1, wherein the first end of the column and the piston are attached to one another by a threaded connection.

19. The actuator according to claim 1, wherein the first end of the column is attached to the piston by a first threaded connection and the second end of the column is attached to the housing by a second threaded connection.

20. The actuator according to claim 1, wherein the housing comprises a first part and a second part that are attached to one another by a first threaded connection, the piston residing in the second part and being attached to the first end of the column by a second threaded connection.

* * * * *